US007674755B2

(12) United States Patent
Egbe et al.

(10) Patent No.: US 7,674,755 B2
(45) Date of Patent: Mar. 9, 2010

(54) FORMULATION FOR REMOVAL OF PHOTORESIST, ETCH RESIDUE AND BARC

(75) Inventors: Matthew I. Egbe, West Norriton, PA (US); Michael Walter Legenza, Bellingham, MA (US)

(73) Assignee: Air Products and Chemicals, Inc., Allentown, PA (US)

( * ) Notice: Subject to any disclaimer, the term of this patent is extended or adjusted under 35 U.S.C. 154(b) by 649 days.

(21) Appl. No.: 11/602,662

(22) Filed: Nov. 21, 2006

(65) Prior Publication Data

US 2007/0149430 A1 Jun. 28, 2007

(51) Int. Cl.
*C11D 7/50* (2006.01)

(52) U.S. Cl. ..... 510/175; 134/1.3

(58) Field of Classification Search ..... 510/175; 134/1.3

See application file for complete search history.

(56) References Cited

U.S. PATENT DOCUMENTS

| | | | | |
|---|---|---|---|---|
| 5,968,848 | A * | 10/1999 | Tanabe et al. | 438/745 |
| 6,475,966 | B1 * | 11/2002 | Sahbari | 510/175 |
| 6,531,436 | B1 * | 3/2003 | Sahbari et al. | 510/176 |
| 6,638,694 | B2 * | 10/2003 | Ikemoto et al. | 430/331 |
| 6,797,682 | B2 * | 9/2004 | Hara et al. | 510/175 |
| 7,431,861 | B2 * | 10/2008 | Toda et al. | 216/93 |
| 2002/0128164 | A1 * | 9/2002 | Hara et al. | 510/175 |
| 2003/0186175 | A1 * | 10/2003 | Ikemoto et al. | 430/331 |
| 2005/0016961 | A1 * | 1/2005 | Toda et al. | 216/83 |
| 2005/0197265 | A1 | 9/2005 | Rath et al. | |
| 2005/0205835 | A1 * | 9/2005 | Tamboli et al. | 252/79.1 |
| 2006/0003910 | A1 * | 1/2006 | Hsu et al. | 510/176 |
| 2006/0014391 | A1 | 1/2006 | Lee et al. | |
| 2006/0014656 | A1 * | 1/2006 | Egbe et al. | 510/175 |
| 2006/0016785 | A1 | 1/2006 | Egbe et al. | |
| 2006/0063687 | A1 * | 3/2006 | Minsek et al. | 510/175 |
| 2006/0234516 | A1 | 10/2006 | Hong et al. | |
| 2006/0287208 | A1 | 12/2006 | Lee et al. | |
| 2006/0293208 | A1 * | 12/2006 | Egbe et al. | 510/407 |
| 2007/0225186 | A1 * | 9/2007 | Fisher | 510/175 |
| 2008/0096785 | A1 * | 4/2008 | Egbe et al. | 510/176 |
| 2009/0082240 | A1 * | 3/2009 | Nukui et al. | 510/176 |
| 2009/0118153 | A1 * | 5/2009 | Rath et al. | 510/176 |
| 2009/0215658 | A1 * | 8/2009 | Minsek et al. | 510/175 |

FOREIGN PATENT DOCUMENTS

| | | | |
|---|---|---|---|
| EP | 1 610 185 | A | 12/2005 |
| EP | 1 736 534 | A | 12/2006 |
| JP | 2005-215627 | A | 8/2005 |
| JP | 2005-333104 | A | 12/2005 |
| JP | 2006-096984 | A | 4/2006 |
| JP | 2006-295118 | A | 10/2006 |
| WO | 2004/107056 | A1 | 12/2004 |
| WO | 2005/085957 | A1 | 9/2005 |

* cited by examiner

*Primary Examiner*—Gregory E Webb
(74) *Attorney, Agent, or Firm*—Lina Yang

(57) ABSTRACT

A formulation for removing photoresist, ion implanted photoresist, etch residue or BARC comprises: an ammonium hydroxide and a 2-aminobenzothiazole, remainder water. Preferably the formulation comprises: tetramethyl ammonium hydroxide, tolyltriazole, propylene glycol, 2-aminobenzothiazole, dipropylene glycol monomethyl ether, remainder water; more preferably: tetramethyl ammonium hydroxide 1-15 wt %, tolyltriazole 1-5 wt %, propylene glycol 5-15 wt %, 2-aminobenzothiazole 1-10 wt %; dipropylene glycol monomethyl ether 20-45 wt %, remainder water. The invention is also a method of removing materials selected from the group consisting of photoresist, etch residue, BARC and combinations thereof, from a substrate comprising: applying a formulation, described above, to the substrate to remove the material from the substrate.

23 Claims, No Drawings

FORMULATION FOR REMOVAL OF PHOTORESIST, ETCH RESIDUE AND BARC

BACKGROUND OF THE INVENTION

Numerous steps are involved in the fabrication of microelectronic structures. Within the manufacturing scheme of fabricating integrated circuits, selective etching of semiconductor surfaces is sometimes required. Historically, a number of vastly different types of etching processes, to selectively remove material have been successfully utilized to varying degrees. Moreover, the selective etching of different layers, within the microelectronic structure, is considered a critical and crucial step in the integrated circuit fabrication process.

In the manufacture of semiconductors and semiconductor microcircuits, it is frequently necessary to coat substrate materials with a polymeric organic substance. Examples of some substrate materials includes titanium, copper, silicon dioxide coated silicon wafer which may further include metallic elements of titanium, copper, and the like. Typically, the polymeric organic substance is a photoresist material. This is a material which will form an etch mask upon development after exposure to light. In subsequent processing steps, at least a portion of the photoresist is removed from the surface of the substrate. One common method of removing photoresist from a substrate is by wet chemical means. The wet chemical compositions formulated to remove the photoresist from the substrate should do so without corroding, dissolving, and/or dulling the surface of any metallic circuitry; chemically altering the inorganic substrate; and/or attacking the substrate itself. Another method of removing photoresist is by a dry ash method where the photoresist is removed by plasma aching using either oxygen or forming gas such as hydrogen. The residues or by-products may be the photoresist itself or a combination of the photoresist, underlying substrate and/or etch gases. These residues or by-products are often referred to as sidewall polymers, veils or fences.

Increasingly, reactive ion etching (RIE) is the process of choice for pattern transfer during via, metal line and trench formation. For instance, complex semi-conductor devices such as advanced DRAMS and microprocessors, which require multiple layers of back end of line interconnect wiring, utilize RIE to produce vias, metal lines and trench structures. Vias are used, through the interlayer dielectric, to provide contact between one level of silicon, silicide or metal wiring and the next level of wiring. Metal lines are conductive structures used as device interconnects. Trench structures are used in the formation of metal line structures. Bottom antireflective coating (BARC) and gap fill materials, which are typically highly cross-linked organic polymer materials, are widely used in semiconductor substrates containing copper. BARC materials may also contain, for example, silicon. Vias, metal lines and trench structures typically expose metals and alloys such as Al—Cu, Cu, Ti, TiN, Ta, TaN, W, TiW, silicon or a silicide such as a silicide of tungsten, titanium or cobalt. The RIE process typically leaves a residue that may include re-sputtered oxide material as well as possibly organic materials from photoresist and antireflective coating materials used to lithographically define the vias, metal lines and or trench structures.

It would therefore be desirable to provide a selective cleaning composition and process capable of removing residues such as, for example, remaining photoresist, BARC and/or processing residues, such as for example, residues resulting from selective etching using plasmas and/or RIE. Moreover, it would be desirable to provide a selective cleaning composition and process, capable of removing residues such as photoresist, BARC and etching residue, that exhibits high selectivity for the residue as compared to metals, high dielectric constant materials (referred to herein as "high-k"), silicon, silicide and/or interlevel dielectric materials including low dielectric constant materials (referred to herein as "low-k"), such as deposited oxides that might also be exposed to the cleaning composition. It would be desirable to provide a composition that is compatible to and can be used with such sensitive low-k films as HSQ, MSQ, FOx, black diamond and TEOS (tetraethylsilicate).

BRIEF SUMMARY OF THE INVENTION

The formulation disclosed herein is capable of selectively removing residues such as, for example, photoresist, ion implanted photoresist, gap fill, BARC and/or other polymeric material, and/or inorganic material and processing residue from a substrate without attacking to any undesired extent metal, low-k dielectric, and/or high-k dielectric materials that might also be exposed to the formulation. The formulation for removing photoresist, etch residue or BARC comprises: an ammonium hydroxide and 2-aminobenzothiazole, remainder water. A preferred formulation comprises: tetramethyl ammonium hydroxide, tolyltriazole, propylene glycol, 2-aminobenzothiazole, dipropylene glycol monomethyl ether, remainder water; more preferably: tetramethyl ammonium hydroxide 1-15 wt %, tolyltriazole 1-5 wt %, propylene glycol 5-15 wt %, 2-aminobenzothiazole 1-10 wt %; dipropylene glycol monomethyl ether 20-45 wt %, remainder water. A specific more preferred formulation comprises: tetramethyl ammonium hydroxide 6.5 wt %, tolyltriazole 3 wt %, propylene glycol 10 wt %, 2-aminobenzothiazole 6 wt %; dipropylene glycol monomethyl ether 39 wt %, remainder water. Another specific more preferred formulation comprises: tetramethyl ammonium hydroxide 5 wt %, tolyltriazole 3 wt %, propylene glycol 12.13 wt %, 2-aminobenzothiazole 1.5 wt %; dipropylene glycol monomethyl ether 40 wt %, remainder water. The invention is also a method of removing materials selected from the group consisting of photoresist, etch residue, BARC and combinations thereof, from a substrate comprising: applying a formulation, described above, to the substrate to remove the material from the substrate.

DETAILED DESCRIPTION OF THE INVENTION

A formulation and method comprising same for selectively removing residues such as, for example, photoresist, ion implanted photoresist, gap fill, bottom antireflective coating (BARC) and other polymeric materials and/or processing residues such as the residues generated by etching are described herein. In a cleaning method involving substrates useful for microelectronic devices, typical contaminants to be removed may include, for example, organic compounds such as exposed and/or ashed photoresist material, ashed photoresist residue, UV- or X-ray-hardened photoresist, C—F-containing polymers, low and high molecular weight polymers, and other organic etch residues; inorganic compounds such as metal oxides, ceramic particles from chemical mechanical planarization (CMP) slurries and other inorganic etch residues; metal containing compounds such as organometallic residues and metal organic compounds; ionic and neutral, light and heavy inorganic (metal) species, moisture, and insoluble materials, including particles generated by processing such as planarization and etching processes. In one particular embodiment, residues removed from the substrate comprise silicon-containing BARC residues.

The residues are typically present in a substrate that may also includes metal, silicon, silicate and/or interlevel dielectric materials such as, for example, deposited silicon oxides and derivatized silicon oxides such as HSQ, MSQ, FOX, TEOS and spin-on glass, chemical vapor deposited dielectric materials, low-k materials and/or high-k materials such as hafnium silicate, hafnium oxide, barium strontium titanate (BST), $TiO_2$, $TaO_5$, wherein both the residues and the metal, silicon, silicide, interlevel dielectric materials, low-k and/or high-k materials will come in contact with the cleaning formulation. The formulation and method disclosed herein provide for selectively removing the residues such as photoresist, ion implanted photoresist, BARC, gap fill, and/or processing residues without significantly attacking the metal, silicon, silicon dioxide, interlevel dielectric materials, low-k and/or high-k materials. In certain embodiments, the substrate may contain a metal, such as, but not limited to, copper, copper alloy, titanium, titanium nitride, tantalum, tantalum nitride, tungsten, and/or titanium/tungsten alloys. In one embodiment, the formulation disclosed herein may be suitable for substrates containing sensitive low-k films. In one particular embodiment, the substrate may comprise a low-k material, a high-k material, or combinations thereof.

In one aspect, there is provided a formulation for removing residues from a substrate comprising BARC the formulation comprising: dipropylene glycol monomethyl ether; tetramethyl ammonium hydroxide; tolyltriazole; propylene glycol; 2-aminobenzothiazole and deionized water. More preferably the formulation is dipropylene glycol monomethyl ether 20-45 wt %; tetramethyl ammonium hydroxide 1-15 wt %; tolyltriazole 1-5 wt %; propylene glycol 5-15 wt %; 2-aminobenzothiazole 1-10 wt % and remainder deionized water. A specific more preferred formulation comprises: tetramethyl ammonium hydroxide 6.5 wt %, tolyltriazole 3 wt %, propylene glycol 10 wt %, 2-aminobenzothiazole 6 wt %; dipropylene glycol monomethyl ether 39 wt %, remainder water. Another specific more preferred formulation comprises: tetramethyl ammonium hydroxide 5 wt %, tolyltriazole 3 wt %, propylene glycol 12.13 wt %, 2-aminobenzothiazole 1.5 wt %; dipropylene glycol monomethyl ether 40 wt %, remainder water. The hydroxide should have no more than 100 ppm contamination of metals such as such as K, Na, etc. The formulation disclosed herein is free of an oxidizer, abrasive particles, or any additional component that adversely affects the stripping and cleaning ability of the formulation or damages one or more surfaces of the underlying substrate. Examples of oxidizers include, but are not limited to, hydrogen peroxide ($H_2O_2$), monopersulfates, iodates, magnesium perphthalate, peracetic acid and other per-acids, persulfates, bromates, periodates, nitrates, nitric acids, iron salts, cerium salts, Mn (III), Mn (IV) and Mn (VI) salts, silver salts, Cu salts, chromium salts, cobalt salts, halogens hypochlorites and mixtures thereof. Examples of abrasive particles include diamond particles and metal oxides, borides, carbides, alumina, ceria and silica and mixtures thereof. In certain embodiments, the formulation is used to remove residues such as abrasive particles contained within CMP solutions from CMP processing. It is preferable that the formulation disclosed herein is free of such particles.

Water is also present in the formulation disclosed herein. Water is present in amounts ranging from about 1% to about 95%, or from about 1 to about 75%, or from about 1 to about 50% by weight. It can be present incidentally as a component of other elements, such as for example, an aqueous solution comprising the fluoride ion source or quaternary ammonium compound, or it can be added separately. Some non-limiting examples of water include deionized water, ultra pure water, distilled water, doubly distilled water, or deionized water having a low metal content.

In certain embodiments, the formulation disclosed herein may contain an organic solvent that is preferably water soluble as an optional component. The water soluble organic solvent may be present in amounts ranging from about 0% to about 60%, or from about 0 to about 55%, or from about 0 to about 50% by weight. Examples of water soluble organic solvents include, but are not limited to, dimethylacetamide (DMAC), N-methyl pyrrolidinone (NMP), dimethylsulfoxide (DMSO), dimethylformamide, N-methylformamide, formamide, dimethyl-2-piperidone (DMPD), tetrahydrofurfuryl alcohol, glycerol, ethylene glycol, and other amides, alcohols or sulfoxides, or multifunctional compounds, such as hydroxyamides or amino alcohols. Further examples of the water soluble organic solvents include diols and polyols such as ($C_2$-$C_{20}$) alkanediols and ($C_3$-$C_{20}$) alkanetriols, cyclic alcohols and substituted alcohols. Particular examples of these water soluble organic solvents include propylene glycol, tetrahydrofurfuryl alcohol, diacetone alcohol and 1,4-cyclohexanedimethanol. In certain embodiments, the organic polar solvent may be DMSO, NMP, and/or DMAC. The water soluble organic solvents enumerated above may be used alone or in combination with two or more solvents.

In certain embodiments, the water soluble organic solvent may comprise a glycol ether. Examples of glycol ethers include ethylene glycol monomethyl ether, ethylene glycol monoethyl ether, ethylene glycol monobutyl ether, ethylene glycol dimethyl ether, ethylene glycol diethyl ether, diethylene glycol monomethyl ether, diethylene glycol monoethyl ether, diethylene glycol monopropyl ether, diethylene glycol monoisopropyl ether, diethylene glycol monobutyl ether, diethylene glycol monolisobutyl ether, diethylene glycol monobenzyl ether, diethylene glycol dimethyl ether, diethylene glycol diethyl ether, triethylene glycol monomethyl ether, triethylene glycol dimethyl ether, polyethylene glycol monomethyl ether, diethylene glycol methyl ethyl ether, ethylene glycol monomethyl ether acetate, ethylene glycol monoethyl ether acetate, propylene glycol methyl ether acetate, propylene glycol monomethyl ether, propylene glycol dimethyl ether, propylene glycol monobutyl ether, propylene glycol, monopropyl ether, dipropylene glycol monomethyl ether, dipropylene glycol monopropyl ether, dipropylene glycol monoisopropyl ether, dipropylene glycol monobutyl ether, dipropylene glycol diisopropyl ether, tripropylene glycol monomethyl ether, 1-methoxy-2-butanol, 2-methoxy-1 -butanol, 2-methoxy-2-methylbutanol, 1,1 -dimethoxyethane and 2-(2-butoxyethoxy) ethanol.

In certain embodiments, the formulation may optionally include from about 0.1% to about 5% by weight of a substituted hydroxylamine or an acid salt thereof. Exemplary hydroxylamines include diethylhydroxylamine and the lactic acid and citric acid salts thereof.

In certain embodiments, the formulation may optionally include an organic acid. The organic acid is present in amounts of from about 0% to about 10%, or from about 0% to 5%, or from about 0% to about 2% by weight of the formulation. Exemplary organic acids include, but are not limited to, citric acid, anthranilic acid, gallic acid, benzoic acid, malonic acid, maleic acid, fumaric acid, D,L-malic acid, isophthalic acid, phthalic acid, and lactic acid.

In certain embodiments, the formulation described herein may optionally include one or more corrosion inhibitors The sulfonic acid or corresponding salt is present in amounts of from about 0% to about 20%, or from about 0% to 10%, or from about 0% to about 5% by weight of the formulation. Examples of suitable corrosion inhibitors include, but are not limited to organic acid salts, catechol, benzotriazole (BZT), resorcinol, other phenols, acids or triazoles, maleic anhydride, phthalic anhydride, catechol, pyrogallol, esters of gallic acid, carboxybenzotriazole, fructose, ammonium thiosulfate, glycine; tetramethylguanidine, iminodiacetic acid, dimethylacetoacetamide, trihydroxybenzene, dihydroxybenzene, salicyclohydroxamic, and mixtures thereof.

The formulation may also include one or more of the following additives: surfactants, chelating agents, chemical modifiers, dyes, biocides, and other additives. Additives may be added to the formulation described herein provided that it does not adversely affect the stripping and cleaning ability of the formulation or the integrity of the underlying metal, silicon, silicon dioxide, interlevel dielectric materials, low-k and/or high-k materials. For example, if the formulation is used to treat a substrate containing copper, the formulation does not include additional additives that would increase the copper etch rate of the formulation. Some examples of representative additives include acetylenic alcohols and derivatives thereof, acetylenic diols (non-ionic alkoxylated and/or self-emulsifiable acetylenic diol surfactants) and derivatives thereof, alcohols, quaternary amines and di-amines, amides (including aprotic solvents such as dimethyl formamide and dimethyl acetamide), alkyl alkanolamines (such as diethanolethylamine), and chelating agents such as beta-diketones, beta-ketoimines, carboxylic acids, mallic acid and tartaric acid based esters and diesters and derivatives thereof, and tertiary amines, diamines and triamines.

Formulations disclosed herein are compatible with substrates containing low-k films such as HSQ (FOx), MSQ, SiLK, etc. The formulations are also effective in stripping photoresists including positive and negative photoresists and plasma etch residues such as organic residues, organometallic residues, inorganic residues, metallic oxides, or photoresist complexes at low temperatures with very low corrosion of copper, and/or titanium containing substrates. Moreover, the formulations are compatible with a variety of metal, silicon, silicon dioxide, interlevel dielectric materials, low-k and/or high-k materials.

During the manufacturing process, a photoresist layer is coated on the substrate. Using a photolithographic process, a pattern is defined on the photoresist layer. The patterned photoresist layer is thus subjected to plasma etch by which the pattern is transferred to the substrate. Etch residues are generated in the etch stage. Some of the substrates used in this invention are ashed while some are not ashed. When the substrates are ashed, the main residues to be cleaned are etchant residues. If the substrates are not ashed, then the main residues to be cleaned or stripped are both etch residues and photoresists.

The method described herein may be conducted by contacting a substrate having a metal, organic or metal-organic polymer, inorganic salt, oxide, hydroxide, or complex or combination thereof present as a film or residue, with the described formulation. The actual conditions, e.g. temperature, time, etc., depend on the nature and the thickness of the material to be removed. In general, the substrate is contacted or dipped into a vessel containing the formulation at a temperature ranging from 20° C. to 85° C., or from 20° C. to 60° C. or from 20° C. to 40° C. Typical time periods for exposure of the substrate to the formulation may range from, for example, 0.1 to 60 minutes, or 1 to 30 minutes, or 1 to 15 minutes. After contact with the formulation, the substrate may be rinsed and then dried. Drying is typically carried out under an inert atmosphere. In certain embodiments, a deionized water rinse or rinse containing deionized water with other additives may be employed before, during, and/or after contacting the substrate with the formulation described herein. However, the formulation can be used in any method known in the art that utilizes a cleaning fluid for the removal of photoresist, ion implanted photoresist, BARC, ash or etch residues and/or residues.

The following are the acronyms used in this Specification:

DPM Dipropylene glycol monomethyl ether

TMAH Tetramethyl ammonium hydroxide

TMAF Tetramethylammonium fluoride

DI water Deionized water

PG Propylene glycol

ABT 2-aminobenzothiazole

TTL Tolyltriazole

Formulations for working examples are listed in Table 1.

TABLE 1

Formulations

| Example A | | Example B | | Example C | |
|---|---|---|---|---|---|
| DPM | 25.00 | DPM | 39.00 | DPM | 50.00 |
| TMAF | 0.30 | TMAF | 0.00 | TMAF | 0.00 |
| TMAH | 6.50 | TMAH | 6.50 | TMAH | 6.50 |
| TTL | 3.00 | TTL | 3.00 | TTL | 3.00 |
| PG | 10.00 | PG | 10.00 | PG | 4.00 |
| ABT | 8.00 | ABT | 6.00 | ABT | 4.00 |
| DI Water | 47.20 | DI Water | 35.50 | DI Water | 32.50 |
| **Example D** | | **Example E** | | **Example F** | |
| DPM | 44.00 | DPM | 40.00 | DPM | 38.00 |
| TMAF | 0.00 | TMAH | 5.00 | TMAH | 5.00 |
| TMAH | 6.50 | TTL | 3.00 | TTL | 3.00 |
| TTL | 3.00 | PG | 12.13 | PG | 16.13 |
| PG | 10.00 | ABT | 1.50 | ABT | 1.50 |
| ABT | 5.00 | DI Water | 38.37 | DI Water | 36.37 |
| DI Water | 31.50 | | | | |

The summary of etch rates on blanket low k dielectrics are provided in Table 2. In all of the following etch rates, measurements were conducted at 5, 10, 20, 40, and 60 minutes of exposure at temperature of 40° C., Thickness measurements were determined at each time interval and graphed using a "least squares fit" model on the results for each exemplary composition. The calculated slope of the "least squares fit" model of each composition is the resultant etch rate provided in angstroms/minute (Å/min). In determining dielectrics etch rate, the wafers had a blanket layer of a known thickness deposited on Si wafer. The initial thickness was determined using a FilmTek 2000 SE Spectroscopic Ellipsometer/Reflectomer. Approximately 200 mls of a test solution was placed in a 250 ml beaker with stirring and heated, if required, to the specified temperature. If only one wafer was placed in a beaker containing solution a dummy wafer was placed in the beaker. After determining the initial thickness, test wafers were immersed in the exemplary compositions. After five minutes, the test wafers were removed from the test solution, rinsed for three minutes with deionized water and completely dried under nitrogen. The thickness of each wafer was measured and if necessary the procedure was repeated on the test wafer.

Examples A, B, D, E, and F were evaluated for low-k compatibility. However, example C was not evaluated for low-k compatibility. However, all six examples were evaluated for their ability to remove photoresist, BARC, and post-etched residues as shown in table 3. Based on the results obtained on patterned wafer, example C did not damage the porous ILD, and was effective in removal of the photoresist and the BARC material.

TABLE 2

| Examples | Temperature ° C. | Etch rates (Å/min) JSR LEB-043 | PDEMS2.5 | PDEMS2.2 | pSiLK |
|---|---|---|---|---|---|
| A | 40 | Not tested | 3 | 4 | 1 |
| B | 40 | 2 | 3 | 7 | Not tested |
| C | 40 | Not tested | Not tested | Not tested | Not tested |
| D | 40 | Not tested | 2 | 7 | Not tested |
| E | 40 | Not tested | 2 | 5 | Not tested |
| F | 40 | Not tested | 1 | >10 | Not tested |

JSR LEB-043 ™: manufactured by JSR Inc.
PDEMS 2.5/2.2 ™: manufactured by Air Products & Chemicals, Inc.
p-SiLK ™: manufactured by Dow Chemical, Inc.

Table 3 illustrates the effectiveness of preferred compositions for removing photoresist, BARC and etch residues from test substrate. The wafer had 193 nm photoresist layers, 193 nm BARC layer, unknown Ultra low-k layer and silicon oxide layer. The substrate was then processed by immersing the substrate in preferred compositions In this procedure, one or more test wafers were placed in a 600 milliliter (ml) beaker that contained 400 mls of each composition. The 600 ml beaker further included a 1 inch stir bar that rotated at 400 revolutions per minute. The compositions having the wafer(s) contained therein were then heated at the time and temperature provided in Table 3. After exposure to the preferred composition, the wafer was rinsed with deionized water and dried with nitrogen gas. The wafer was cleaved to provide an edge and then examined using scanning electron microscopy (SEM) on a variety of pre-determined locations on the wafer and the result of the cleaning performance and damage to the underlying interlayer dielectric (ILD) were visually interpreted and coded as provided in Table 3 in following manner: for cleaning "+" indicates excellent, "P" indicates partial removal and "−" indicates poor and for ILD damage "+" indicates no damage and "−" indicates damage.

TABLE 3

| Examples | temperature ° C. | SEM Results time minutes | photoresist clean | BARC clean | ILD damage |
|---|---|---|---|---|---|
| A | 40 | 15 | + | P | − |
| B | 40 | 15 | + | + | + |
| C | 40 | 15 | + | + | + |
| D | 40 | 15 | + | P | + |
| E | 40 | 15 | + | + | + |
| F | 40 | 15 | + | + | + |

Based on the results obtained on patterned wafer, examples C, B, D, E and F did not damage the porous ILD. All six examples were effective in removal of the photoresist. On the other hand, examples B, C, E and F were effective in the removal of the BARC material.

While specific embodiments have been described in details, those with ordinary skill in the art will appreciate that various modifications and alternatives to those details could be developed in light of the overall teaching of the disclosure. Accordingly, the particular arrangements disclosed are meant to be illustrative only and not limiting to the scope of the invention, which is to be given the full breath of the appended claims and any all equivalents thereof.

The invention claimed is:

1. A formulation for removing photoresist, ion implanted photoresist, BARC and/or etch residue wherein the formulation comprises: an ammonium hydroxide and a 2-aminobenzothiazole, remainder water, provided that the hydroxide should have no more than 100 ppm contamination of metals.

2. The formulation of claim 1 is free of an oxidizer, abrasive particles.

3. The formulation of claim 1 wherein the ammonium hydroxide is selected from the group consisting of tetramethyl ammonium hydroxide, tetramethylammonium fluoride and the mixtures thereof.

4. The formulation of claim 1 further comprises 0 to 60 wt % of a water soluble organic solvent selected from the group consisting of dimethylacetamide (DMAC), N-methyl pyrrolidinone (NMP), dimethylsulfoxide (DMSO), dimethylformamide, N-methylformamide, formamide, dimethyl-2-piperidone (DMPD), tetrahydrofurfuryl alcohol, glycerol, ethylene glycol, amides, alcohols, sulfoxides, multifunctional compounds, hydroxyamides, amino alcohols diols and polyols, ($C_2$-$C_{20}$) alkanediols, ($C_3$-$C_{20}$) alkanetriols, cyclic alcohols, propylene glycol, tetrahydrofurfuryl alcohol, diacetone alcohol, 1,4-cyclohexanedimethanol, glycol ether and the mixtures thereof.

5. The formulation of claim 1 further comprises 0.1 to 5 wt % of a substituted hydroxylamine or an acid salt.

6. The formulation of claim 1 further comprises 0 to 10 wt % of an organic acid selected from the group consisting of citric acid, anthranilic acid, gallic acid, benzoic acid, malonic acid, maleic acid, fumaric acid, D,L-malic acid, isophthalic acid, phthalic acid, lactic acid and the mixtures thereof.

7. The formulation of claim 1 further comprises 0 to 20 wt % of a corrosion inhibitors selected from the group consisting of organic acid salts, phenols, acids, triazoles, catechol, benzotriazole (BZT), resorcinol, maleic anhydride, phthalic an hydride, catechol, pyrogallol, esters of gallic acid, carboxybenzotriazole, fructose, ammonium thiosulfate, glycine, tetramethylguanidine, iminodiacetic acid, dimethylacetoacetamide, trihydroxybenzene, dihydroxybenzene, salicyclohydroxamic, and mixtures thereof.

8. The formulation of claim 1 further comprises an additive selected from the group consisting of: surfactants, chelating agents, chemical modifiers, dyes, biocides, and the mixtures thereof; provided that the additive does not adversely affect the stripping and cleaning ability of the formulation or the integrity of the underlying metal, silicon, silicon dioxide, interlevel dielectric materials, low-k and/or high-k materials.

9. A formulation for removing photoresist, ion implanted photoresist, BARC and/or etch residue wherein the formulation comprises: tetramethyl ammonium hydroxide, tolyltriazole, propylene glycol, 2-aminobenzothiazole, dipropylene glycol monomethyl ether, remainder water, provided that the hydroxide should have no more than 100 ppm contamination of metals.

10. The formulation of claim 9 wherein the formulation comprises: tetramethyl ammonium hydroxide 1-15 wt %, tolyltriazole 1-5 wt %, propylene glycol 5-15 wt %, 2-aminobenzothiazole 1-10 wt %; dipropylene glycol monomethyl ether 20-45 wt %, remainder water.

11. The formulation of claim 9 wherein the formulation comprises: tetramethyl ammonium hydroxide 6.5 wt %, tolyltriazole 3 wt %, propylene glycol 10 wt %, 2-aminobenzothiazole 6 wt %; dipropylene glycol monomethyl ether 39 wt %, remainder water.

12. The formulation of claim 9 wherein the formulation comprises: tetramethyl ammonium hydroxides 5 wt %, tolyltriazole 3 wt %, propylene glycol 12.13 wt %, 2-aminobenzothiazole 1.5 wt %; dipropylene glycol monomethyl ether 40 wt %, remainder water.

13. A method of removing materials selected from the group consisting of photoresist, ion implanted photoresist, etch residue, BARC and combinations thereof, from a substrate comprising: applying a formulation according to claim 1 to the substrate to remove the material from the substrate.

14. The method of claim 13 wherein the formulation is free of an oxidizer, abrasive particles.

15. The method of claim 13 wherein the formulation further comprises 0% to 60% by weight of a water soluble organic solvent selected from the group consisting of dimethylacetamide (DMAC), N-methyl pyrrolidinone (NMP), dimethylsulfoxide (DMSO), dimethylformamide, N-methylformamide, formamide, dimethyl-2-piperidone (DMPD), tetrahydrofurfuryl alcohol, glycerol, ethylene glycol, amides, alcohols, sulfoxides, multifunctional compounds, hydroxyamides, amino alcohols diols and polyols, ($C_2$-$C_{20}$) alkanediols, ($C_3$-$C_{20}$) alkanetriols, cyclic alcohols, propylene glycol, tetrahydrofurfuryl alcohol, diacetone alcohol, 1,4-cyclohexanedimethanol, glycol ether and the mixtures thereof.

16. The method of claim 13 wherein the formulation further comprises 0.1 to 5 wt % of a substituted hydroxylamine or an acid salt.

17. The method of claim 13 wherein the formulation further comprises 0 to 10 wt % of an organic acid selected from the group consisting of citric acid, anthranilic acid, gallic acid, benzoic acid, malonic acid, maleic acid, fumaric acid, D,L-malic acid, isophthalic acid, phthalic acid, lactic acid and the mixtures thereof.

18. The method of claim 13 wherein the formulation further comprises 0 to 20 wt % of a corrosion inhibitors selected from the group consisting of organic acid salts, phenols, acids, triazoles, catechol, benzotriazole (BZT), resorcinol, maleic anhydride, phthalic anhydride, catechol, pyrogallol, esters of gallic acid, carboxybenzotriazole, fructose, ammonium thiosulfate, glycine, tetramethylguanidine, iminodiacetic acid, dimethylacetoacetamide, trihydroxybenzene, dihydroxybenzene, salicyclohydroxamic, and mixtures thereof.

19. The method of claim 13 wherein the formulation further comprises an additive selected from the group consisting of: surfactants, chelating agents, chemical modifiers, dyes, biocides, and the mixtures thereof; provided that the additive does not adversely affect the stripping and cleaning ability of the formulation or the integrity of the underlying metal, silicon, silicon dioxide, interlevel dielectric materials, low-k and/or high-k materials.

20. A method of removing materials selected from the group consisting of photoresist, ion implanted photoresist, etch residue, BARC and combinations thereof, from a substrate comprising: applying a formulation according to claim 9 to the substrate to remove the material from the substrate.

21. The method of claim 20 wherein the formulation comprises: tetramethyl ammonium hydroxide 1-15 wt %, tolyltriazole 1-5 wt %, propylene glycol 5-15 wt %, 2-aminobenzothiazole 1-10 wt %; dipropylene glycol monomethyl ether 20-45 wt %, remainder water.

22. The method of claim 20 wherein the formulation comprises: tetramethyl ammonium hydroxide 6.5 wt %, tolyltriazole 3 wt %, propylene glycol 10 wt %, 2-aminobenzothiazole 6 wt %; dipropylene glycol monomethyl ether 39 wt %, remainder water.

23. The method of claim 20 wherein the formulation comprises: tetramethyl ammonium hydroxides 5 wt %, tolyltriazole 3 wt %, propylene glycol 12.13 wt %, 2-aminobenzothiazole 1.5 wt %; dipropylene glycol monomethyl ether 40 wt %, remainder water.

* * * * *